US008662940B2

(12) United States Patent
Decuyper et al.

(10) Patent No.: US 8,662,940 B2
(45) Date of Patent: Mar. 4, 2014

(54) ELECTRICAL CONNECTORS AND METHODS FOR COUPLING THE ELECTRICAL CONNECTORS TO BUSBARS

(75) Inventors: Johan Decuyper, Oost Vlaanderen (BE); Tomasz Tomanek, Slaskie (PL)

(73) Assignee: General Electric Company, Schenectady, NY (US)

( * ) Notice: Subject to any disclaimer, the term of this patent is extended or adjusted under 35 U.S.C. 154(b) by 11 days.

(21) Appl. No.: 13/338,473

(22) Filed: Dec. 28, 2011

(65) Prior Publication Data

US 2013/0171889 A1 Jul. 4, 2013

(51) Int. Cl.
*H01R 13/20* (2006.01)

(52) U.S. Cl.
USPC ..... 439/793; 439/806

(58) Field of Classification Search
USPC ..... 439/791–793, 806
See application file for complete search history.

(56) References Cited

U.S. PATENT DOCUMENTS

| | | | | |
|---|---|---|---|---|
| 905,773 | A | 12/1908 | Vibber | |
| 1,663,005 | A | 3/1928 | Hendee | |
| 2,083,606 | A | 6/1937 | Johansson | |
| 2,097,324 | A | 10/1937 | Hill | |
| 2,136,366 | A * | 11/1938 | Martin | 439/806 |
| 2,357,171 | A | 8/1944 | Carlson | |
| 2,574,781 | A | 11/1951 | Greene et al. | |
| 2,651,767 | A | 9/1953 | Bergan | |
| 3,041,574 | A | 6/1962 | Cornell, Jr. | |
| 3,798,585 | A | 3/1974 | Thompson et al. | |
| 3,985,411 | A * | 10/1976 | Mooney et al. | 439/791 |
| 4,722,703 | A | 2/1988 | Hufnagl | |
| 4,784,621 | A | 11/1988 | Auclair | |
| 4,849,581 | A | 7/1989 | Larkin et al. | |
| 4,859,193 | A | 8/1989 | Pfannkuche et al. | |
| 4,875,876 | A | 10/1989 | O'Loughlin | |
| 4,950,841 | A | 8/1990 | Walker et al. | |

(Continued)

FOREIGN PATENT DOCUMENTS

| | | |
|---|---|---|
| DE | 3330984 A1 | 3/1985 |
| DE | 4124066 A1 | 1/1993 |

(Continued)

OTHER PUBLICATIONS

Search Report and Written Opinion from EP Application No. 12197433.1 dated Apr. 3, 2013.

(Continued)

*Primary Examiner* — Gary Paumen
(74) *Attorney, Agent, or Firm* — Global Patent Operation; Stephen G. Midgley

(57) ABSTRACT

Electrical connectors and associated methods for coupling to a first busbar extending in a first direction to a second busbar extending in a second direction are disclosed. A connector has a first mounting portion including a receiving portion configured to receive an end portion of the first busbar. A clamping portion is coupled to the receiving portion and configured to extend over the first busbar. The clamping portion is configured to impart a clamping force in a third direction toward the second busbar when the second busbar is disposed between the clamping portion and the first busbar. The connector also includes a second mounting portion coupled to the clamping portion, the second mounting portion arranged to be coupled to the first busbar to fixedly hold the second busbar between the clamping portion and the first busbar and to electrically couple the second busbar to the first busbar.

17 Claims, 11 Drawing Sheets

(56) References Cited

U.S. PATENT DOCUMENTS

| | | | | |
|---|---|---|---|---|
| 4,966,563 | A | 10/1990 | Pierce et al. | |
| 5,114,354 | A | 5/1992 | Franks, Jr. | |
| 5,783,779 | A | 7/1998 | Graham et al. | |
| 5,821,464 | A | 10/1998 | Graham et al. | |
| 5,934,818 | A | 8/1999 | Schmitt et al. | |
| 6,224,433 | B1 | 5/2001 | Chadbourne et al. | |
| 6,471,553 | B2 | 10/2002 | Kasai | |
| 6,855,012 | B2 * | 2/2005 | An | 439/793 |
| 7,410,385 | B2 | 8/2008 | Buttner | |
| 7,775,818 | B2 | 8/2010 | Listl et al. | |

FOREIGN PATENT DOCUMENTS

| | | | |
|---|---|---|---|
| DE | 19731858 | A1 | 1/1999 |
| DE | 29816627 | U1 | 1/1999 |
| EP | 234735 | A1 | 9/1987 |
| EP | 1014494 | A1 | 6/2000 |
| EP | 1345284 | A2 | 9/2003 |

OTHER PUBLICATIONS

Search Report from EP Application No. 13160765.7 dated Aug. 1, 2013.

* cited by examiner

ELECTRICAL CONNECTORS AND METHODS FOR COUPLING THE ELECTRICAL CONNECTORS TO BUSBARS

BACKGROUND OF THE INVENTION

Electrical busbars, such as elongated rectangular flat conductive bus bars, have long been utilized in the electrical distribution industry to conduct electricity. Two electrical busbars have been conventionally connected together by drilling or otherwise forming holes through the two electrical busbars and coupling the busbars together utilizing bolts disposed through the holes. The drilling process, however, is a labor intensive and time consuming task. Additionally, the need for bolts adds cost and labor for installation.

Accordingly, the inventors herein have recognized a need for improved electrical connectors.

BRIEF DESCRIPTION OF THE INVENTION

An electrical connector for coupling to a first busbar to a second busbar. An connector for coupling a first busbar extending in a first direction to a second busbar extending in a second direction, in accordance with an exemplary embodiment is provided. The connector includes a first mounting portion having a receiving portion, receiving portion configured to receive an end portion of the first busbar. The connector also includes a clamp portion coupled to an end of the receiving portion and configured to extend over the first busbar, the clamping portion configured to impart a clamping force in a third direction toward the second busbar when the second busbar is disposed between the clamping portion and the first busbar, and a second mounting portion coupled to the clamping portion, the second mounting portion configured to be coupled to the first busbar to fixedly hold the second busbar between the clamping portion and the first busbar and to electrically couple the second busbar to the first busbar.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 11:
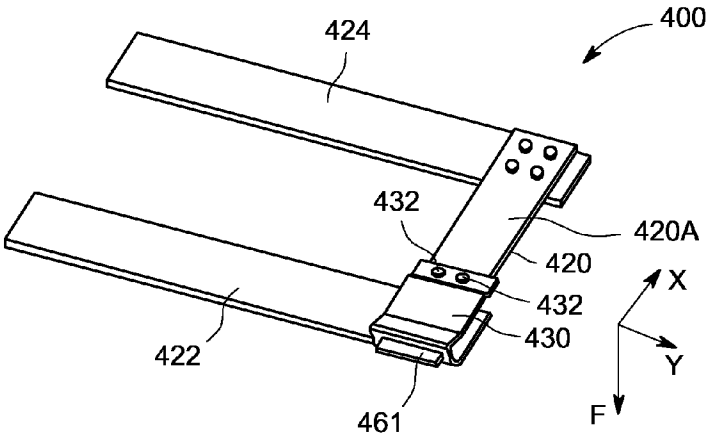
FIG. 11 is a schematic of an electrical circuit having an electrical connector in accordance with an exemplary embodiment.
Figure 12:
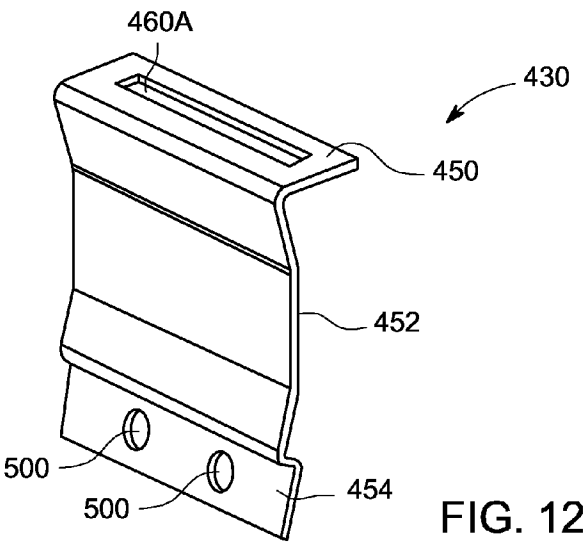
FIG. 12 is a schematic of the electrical connector of FIG. 11 in accordance with an exemplary embodiment.

Referring to FIG. 11, an electrical circuit 400 in accordance with an exemplary embodiment is provided. The electrical circuit 400 includes a first busbar 420 having a top surface 420A and a bottom surface 420B; a second busbar 422 having a top surface 422A and a bottom surface 422B; a third busbar 424; an electrical connector 430; and at least one fastener 432 such as a bolt, and a corresponding nut (not shown). The first busbar 420, the second busbar 422, and the third busbar 424 are each constructed of electrically conductive material for conducting electricity therethrough. In one exemplary embodiment, the first busbar 420, the second busbar 422, and the third busbar 424 are constructed of copper.

In an embodiment, the first busbar 420 is coupled at a first end to the second bus bar 422 by the electrical connector 430, and coupled at a second end to third busbar 424 via fasteners, such as bolts. In another embodiment, the first busbar 420 is coupled at a first end to third bus bar 424 by a first electrical connector 430, and coupled at a second end to first busbar 420 via a second electrical connector 430 (not shown).

In an embodiment the electrical connector 430 is configured to electrically couple the first busbar 420 extending in a first direction "X", and the second busbar 422 extending in a second direction "Y". In an embodiment, the first and second directions X, Y are substantially orthogonal. An advantage of the electrical connector 430 is that the connector 430 can be coupled to the second busbar 422 without the need to form holes in the busbar 422, such as by drilling.

Referring to FIGS. 11-13A, and in an embodiment, the electrical connector 430 includes a first mounting portion 450, a clamping portion 452, and a second mounting portion 454. The electrical connector 430 is constructed of an electrically conductive material for conducting electricity therethrough. In one exemplary embodiment, the electrical connector 430 is constructed of copper. In alternative embodiments, the electrical connector 430 may be constructed of any desired electrically conductive material suitable for a purpose disclosed herein.

Figure 13:
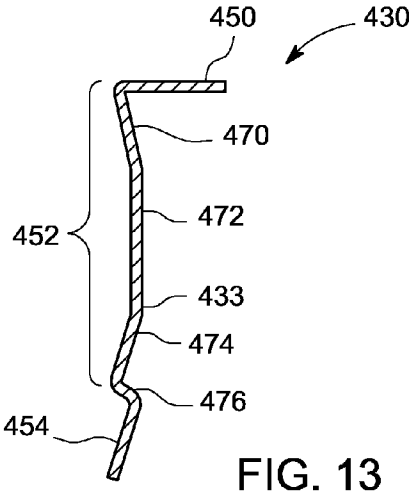
FIG. 13 is a cross-sectional schematic of an embodiment of the electrical connector of FIG. 11.
Figure 13A:
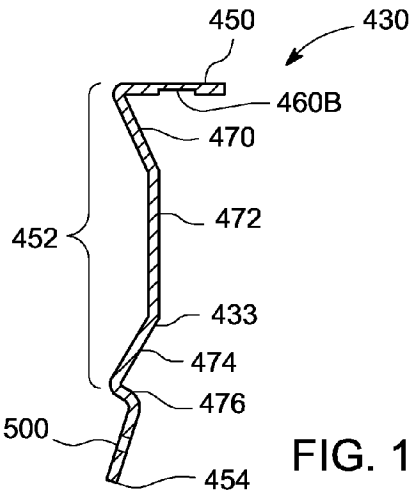
FIG. 13A is a cross-sectional schematic of an embodiment of the electrical connector of FIG. 11.

The first mounting portion 450 comprises a receiving portion 460. The receiving portion 460 is sized and disposed to receive an end portion 461 of the first busbar 420. In one embodiment, the receiving portion 460 defines a first aperture 460A extending therethrough sized and disposed to receive the end portion 461 of the first busbar 420 therethrough (FIG. 13). In another embodiment, the receiving portion 460 defines a slot 460B sized and disposed to receive the end portion 461 of the first busbar 420 therein (FIG. 13A). One advantage of an embodiment having aperture 460A is that connector 430 is adjustably positionable on at least one of first busbar 420 and second busbar 422.

The clamping portion 452 is coupled to the first mounting portion 450 and is configured and arranged to extend over a portion of the first busbar 420. The clamping portion 452 is configured to operatively impart a clamping force in a third direction indicated by arrow F, i.e., toward the the second busbar 422 when the second busbar 422 is disposed between the clamping portion 452 and the first busbar 420. In an embodiment, the third direction F is substantially orthogonal to both the first and second directions. In an embodiment, the clamping portion 452 further comprises a resilient pivoting member 433 and disposed to operatively impart a clamping force in the third direction F through clamping portion 452 toward the second busbar 422 during an installation of connector 430. For example, during an installation of connector 430, a mounting force generally in the third direction F is applied by a user to the second mounting plate portion, such as through the at least one fastener 432, thereby causing a flexing or bending of resilient pivoting member 433 whereby clamping portion 452 imparts a clamping force in the third direction F.

In an embodiment, the clamping portion 452 comprises a first hinge portion 470, a first contact portion 472, a second contact portion 474, and a coupling portion 476. In an embodiment, the first hinge portion 470 extends outwardly from an end of the first mounting portion 450 at an acute angle relative to the first mounting portion 450. The first contact portion 472 is coupled to and disposed between the first hinge portion 470 and the second contact portion 474. In an embodiment, the first contact portion 472 is disposed generally perpendicular to the first mounting portion 450. The second contact portion 474 is coupled to and disposed between the first contact portion 472 and the coupling portion 476. The coupling portion 476 extends generally perpendicular to the second contact portion 474 and is coupled to the second mounting portion 454. In an embodiment, the second mounting portion 454 extends generally perpendicular to the portion 476. In an embodiment, clamping portion 452 is configured to contact the top surface 422A of the second busbar 422. In other embodiments an intermediate plate, such as a conductive shim (not shown) may be disposed between the clamping portion 452 and the second busbar 422.

The second mounting portion 454 is coupled to the clamping portion 452. The second mounting portion 454 is configured to be coupled to the first busbar 420 such that the second busbar 422 is fixedly held between the clamping portion 452 and the first busbar 420, and the second busbar 422 is electrically coupled to the first busbar 420. For example, in one embodiment, the second mounting portion 454 defines at least one second mounting portion aperture 500 extending therethrough and sized and disposed to operably align with a corresponding at least one aperture 420 defined in the first busbar 420.

In an embodiment, the at least one fastener 432, such as a bolt, is disposed to extend through the second mounting portion aperture 500 and the corresponding at least one aperture 420 defined in first busbar 420 and is coupled to a first nut (433).

Referring to FIGS. 14-18, a flowchart of a method for coupling the electrical connector 430 to the first busbar 420 and the second busbar 422 in accordance with another exemplary embodiment will now be explained.

At step 600, the user provides the electrical connector 430 having the first mounting portion 450 comprising the receiving portion 460 formed therein, the clamping portion 452 coupled to an end of the-first mounting portion 450, and the second mounting portion 454 coupled to an end of the clamping portion 452. The second mounting portion 454 having at least one second mounting portion aperture aperture 500 defined therethrough.

Figure 14:
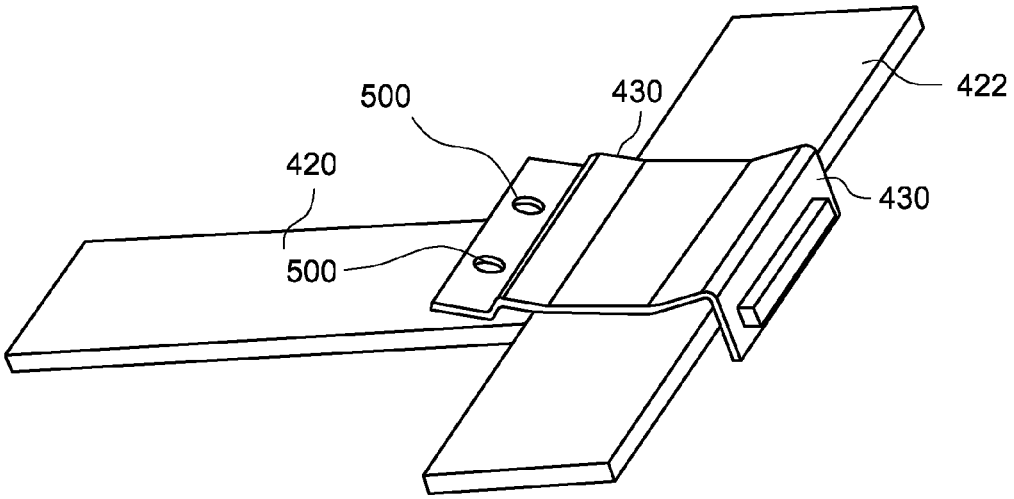
FIG. 14 is a schematic of an embodiment of the electrical connector of FIG. 11 in a flexed configuration disposed on first and second busbars.
Figure 15:
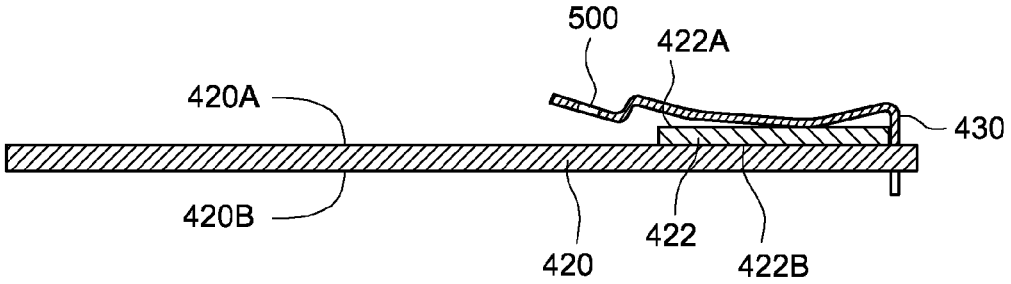
FIG. 15 is a cross-sectional schematic of an embodiment of the electrical connector and the first and second busbars of FIG. 14.

At step 602, the user inserts an end portion 461 of the first busbar 420 into the receiving portion 460 of the first mounting portion 450 (as shown in FIGS. 14 and 15) such that the clamping portion 452 extends over a portion of the first busbar 420 extending in a first direction.

At step 604, the user disposes a second busbar 422 to extend in a second direction substantially perpendicular to the first direction, and between the clamping portion 452 and the first busbar 420 (as shown in FIGS. 14 and 15).

Figure 16:
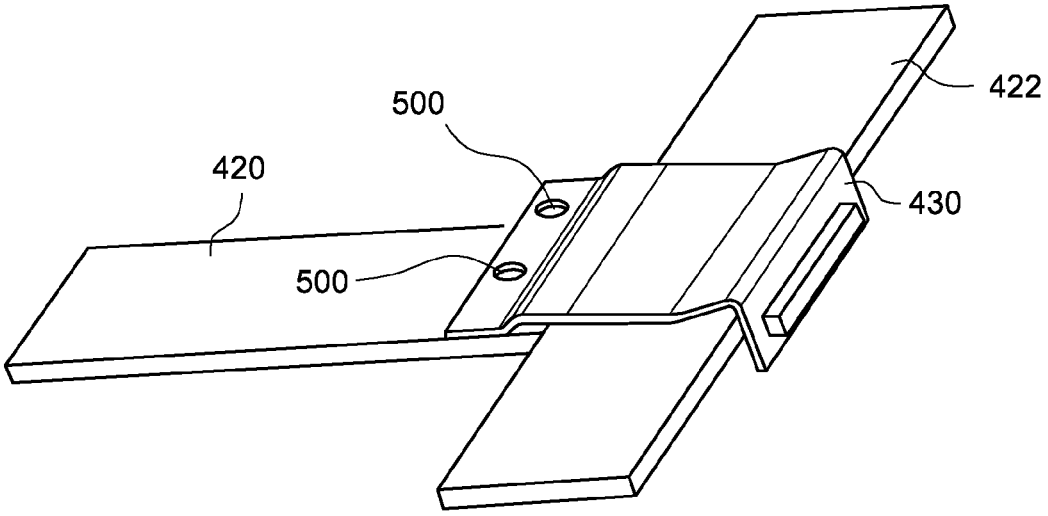
FIG. 16 is a schematic of an embodiment of the electrical connector of FIG. 11 configuration and disposed on the first and second busbars.
Figure 17:
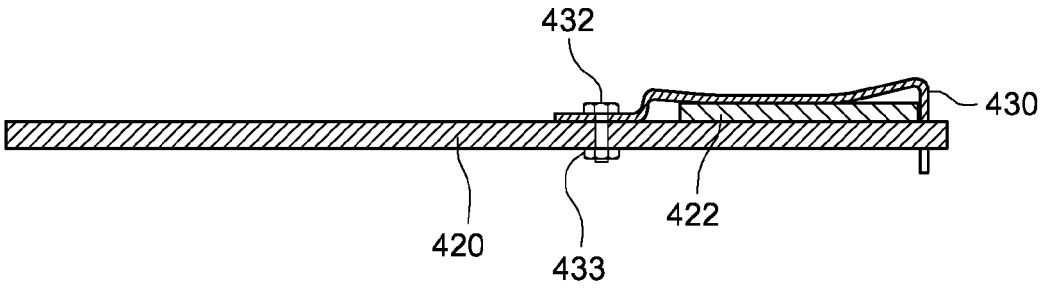
FIG. 17 is a cross-sectional schematic of the electrical connector and the first and second busbars of FIG. 16.

At step 606, the user applies a force in the third direction F substantially orthogonal the first and second directions, to move the clamping portion 452 toward the second busbar 422 (as shown in FIGS. 16 and 17) such that clamping portion 452 imparts a clamping force in the third direction F, i.e., toward the the second busbar 422 to electrically couple the second busbar 422 and the first busbar 420.

At step 608, the user fastens the connector 430 to the first busbar 420 by disposing a portion of the bolt 432 through the at least one second mounting portion aperture 500 and through an corresponding aperture of the first busbar 420 and coupling a threaded end of the bolt 432 to a first nut.

Figure 1:
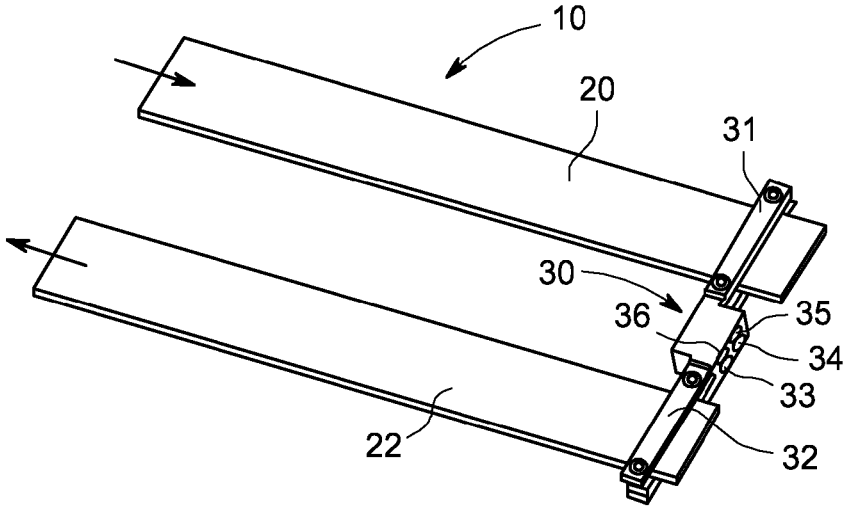
FIG. 1 is a schematic of an electrical circuit having an electrical connector in accordance with an exemplary embodiment.
Figure 2:
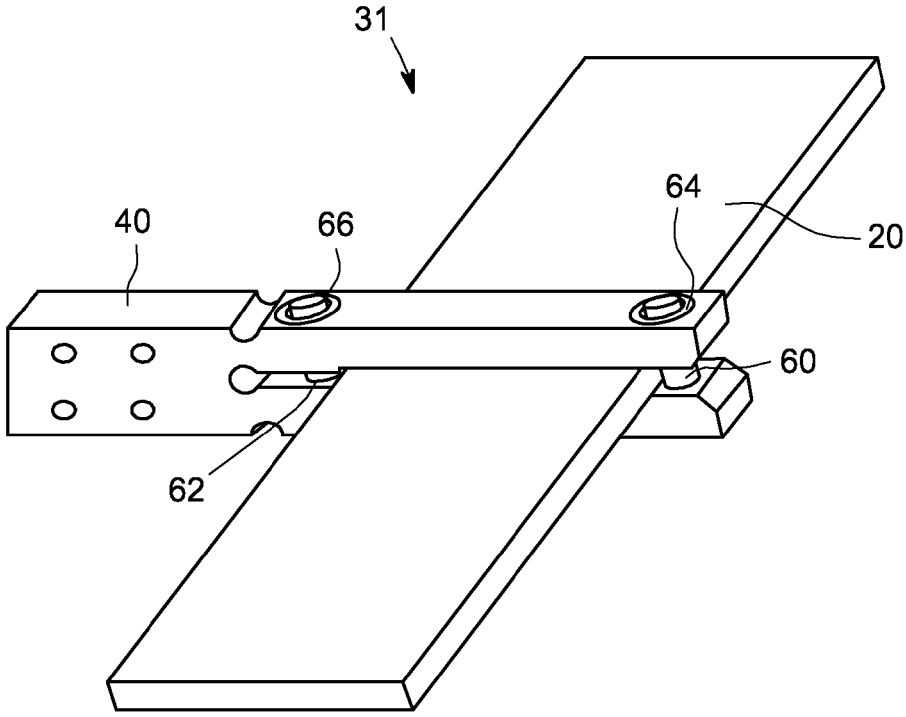
FIG. 2 is a schematic of a first connector portion of the electrical connector of FIG. 1.
Figure 3:
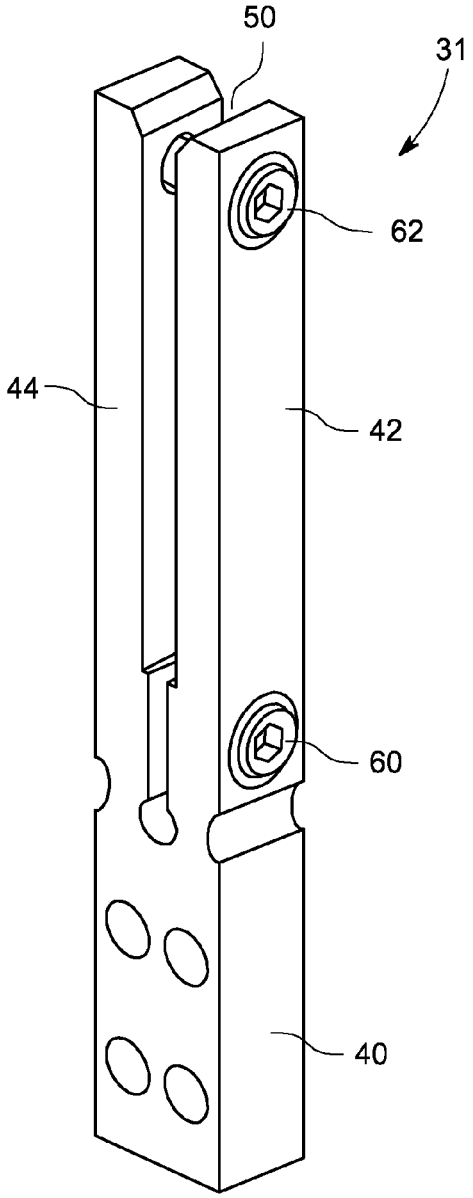
FIG. 3 is another schematic of the first connector portion of the electrical connector of FIG. 1.
Figure 4:
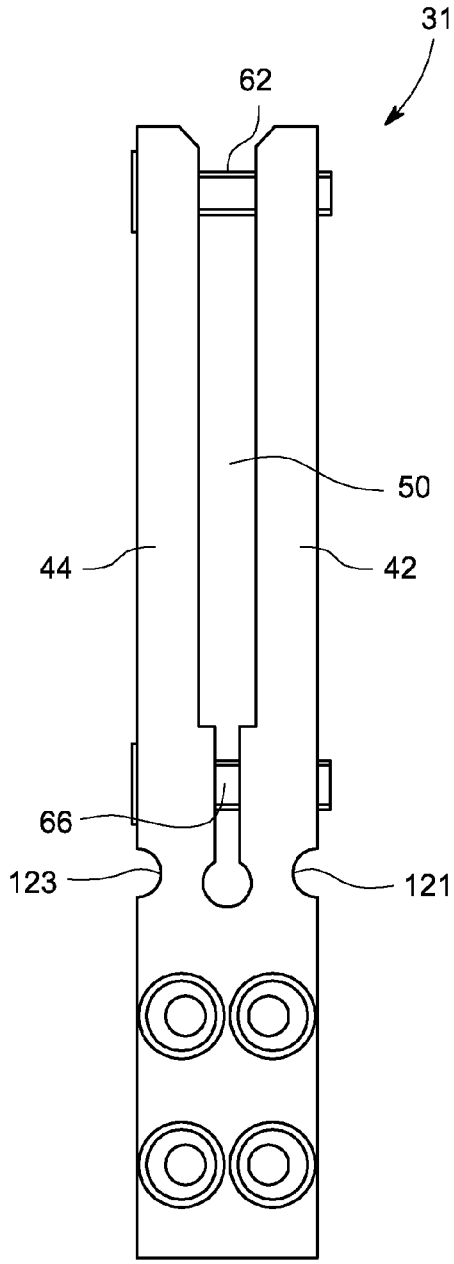
FIG. 4 is a side view of the first connector portion of FIG. 3.

Referring to FIGS. 1-3, an electrical circuit 10 having a first busbar 20, a second busbar 22, and an electrical connector 30 in accordance with an exemplary embodiment is illustrated. An advantage of the electrical connector 30 is that the connector 30 is coupled to the first busbar 20 and the second busbar 22 without drilling holes in the busbars 20, 22.

The first busbar 20 and the second busbar 22 are each constructed of an electrically conductive material for conducting electricity therethrough. In one exemplary embodiment, the first busbar 20 and the second busbar 22 are constructed of copper.

The electrical connector 30 includes a first connector portion 31, a second connector portion 32, and fasteners such as bolts 33, 34, 35, 36 for example. The first connector portion 31 is coupled to the second connector portion 32 utilizing the bolts 33, 34, 35, 36.

Referring to FIGS. 1 and 3-5, the first connector portion 31 is configured to be coupled to the second connector portion 32 and to the busbar 20. The first connector portion 31 includes a mounting portion 40, coupling tabs 42, 44, fasteners such as bolts 60, 62, and nuts 64, 66. The mounting portion 40 may be block-shaped and includes apertures 80, 82, 84, 86 extending therein. In one exemplary embodiment, the block-shaped mounting portion 40 is parallelepiped shaped. The mounting portion 40 is constructed of an electrically conductive material. In one exemplary embodiment, the mounting portion 40 is constructed of copper. Of course, in an alternative embodiment, the mounting portion 40 could be constructed of another electrically conductive material suitable for a purpose disclosed herein.

Figure 5:
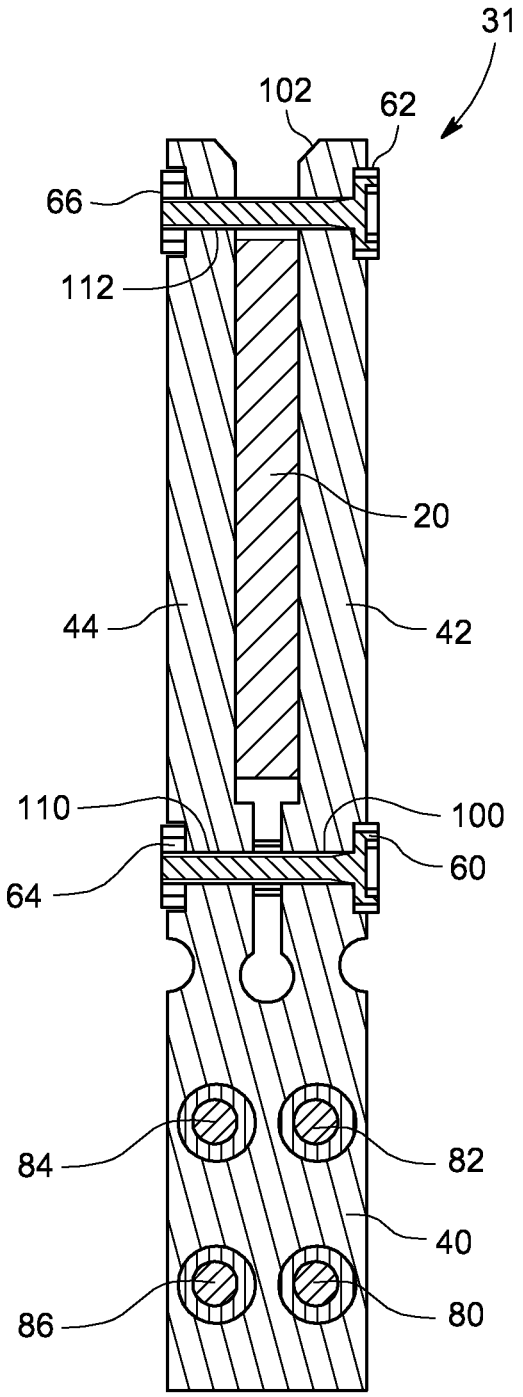
FIG. 5 is a cross-sectional view of the first connector portion of FIG. 3.
Figure 6:
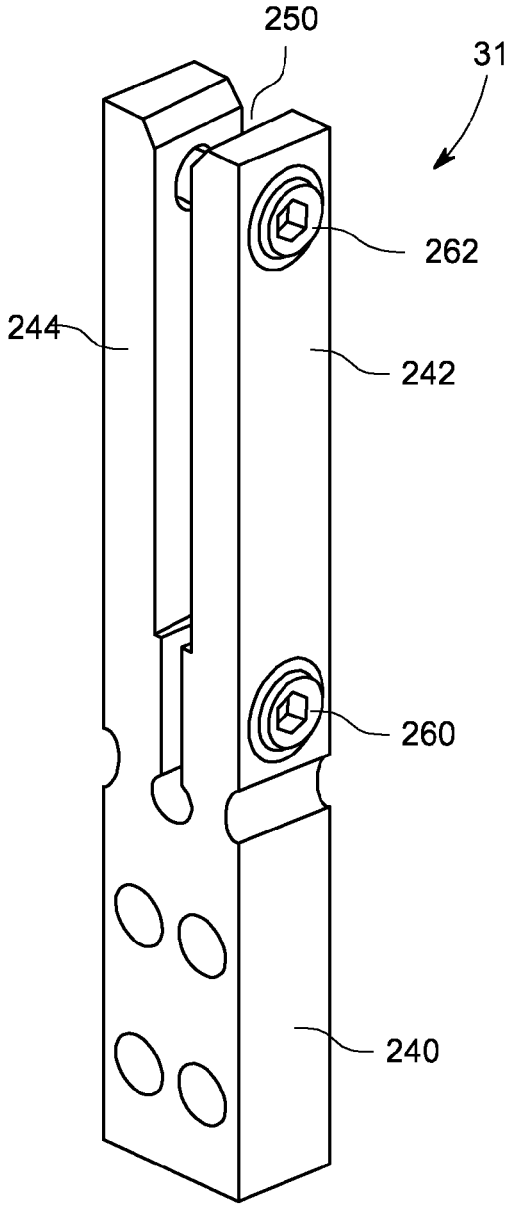
FIG. 6 is a schematic of a second connector portion of the electrical connector of FIG. 1.
Figure 7:
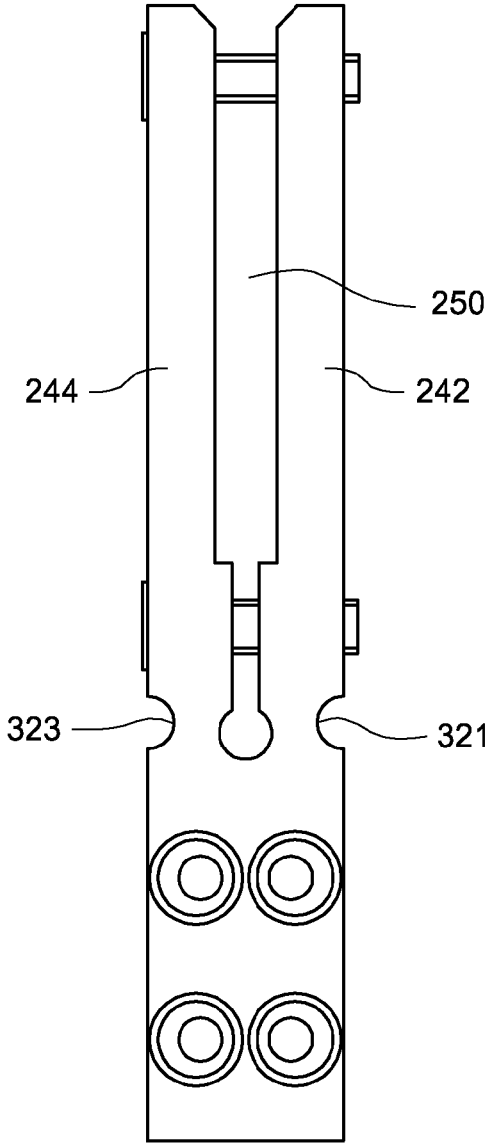
FIG. 7 is a side view of the second connector portion of FIG. 6.
Figure 8:
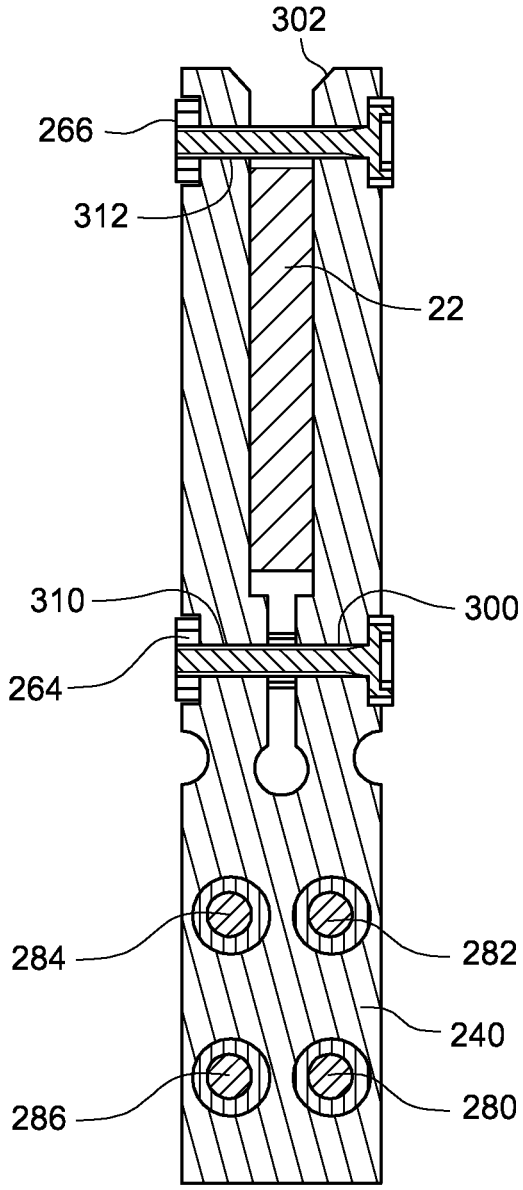
FIG. 8 is a cross-sectional view of the second connector portion of FIG. 6.

Referring to FIGS. 3 and 5, the coupling tabs 42, 44 are configured to hold the busbar 20 therebetween. The coupling tab 42 extends from the mounting portion 40 in a first direction. The coupling 42 has apertures 100, 102 extending therethrough. The coupling tab 44 extends from the mounting portion 40 in the first direction such that a gap 50 is formed between the coupling tabs 42, 44. The gap 50 has a size sufficient to receive an end portion of the busbar 20 therein. The coupling tab 44 has apertures 110, 112 extending therethrough. The apertures 110, 112 in the coupling tab 44 are aligned with the apertures 100, 102 respectively in the coupling tab 42. The coupling tabs 42, 44 have grooves 121, 123, respectively, disposed proximate to the mounting portion 40, wherein the coupling tabs 42, 44 are bendable proximate the grooves 121, 123, respectively, toward one another. The coupling tabs 42, 44 are each constructed of an electrically conductive material. In one exemplary embodiment, coupling tabs 42, 44 are constructed of copper. Of course, in an alternative embodiment, the coupling tabs 42, 44 could each be constructed of another electrically conductive material suitable for a purpose disclosed herein.

The bolt 60 is configured to be disposed through the apertures 100, 110 and is coupled to the nut 64. The bolt 62 is configured to be disposed through the apertures 102, 112 and is coupled to the nut 66. When bolts 60, 62 are tightened within the nuts 64, 66, respectively, the coupling tabs 42, 44 are urged towards one another such that the coupling tabs 42, 44 are fixedly clamped against the first busbar 20 disposed through the gap 50 between the coupling tabs 42, 44. Also, the mounting portion 40 is electrically coupled to the first busbar 20 via the coupling tabs 42, 44.

Referring to FIGS. 6-9, the second connector portion 32 is configured to be coupled to the first connector portion 31 and to the busbar 22. The second connector portion 32 includes a mounting portion 240, coupling tabs 242, 244, fasteners such as bolts 260, 262, and nuts 264, 266. The mounting portion 240 may be block-shaped and includes apertures 280, 282, 284, 286 extending therein. In one exemplary embodiment, the block-shaped mounting portion 240 is parallelepiped shaped. The mounting portion 240 is constructed of an electrically conductive material. In one exemplary embodiment, the mounting portion 240 is constructed of copper. Of course, in an alternative embodiment, the mounting portion 240 could be constructed of another electrically conductive material suitable for a purpose disclosed herein.

The coupling tabs 242, 244 are configured to hold the busbar 22 therebetween. The coupling tab 242 extends from the mounting portion 240 in a first direction. The coupling 242 has apertures 300, 302 extending therethrough. The coupling tab 244 extends from the mounting portion 240 in the first direction such that a gap 250 is formed between the coupling tabs 242, 244. The gap 250 has a size sufficient to receive the busbar 22 therein. The coupling tab 244 has apertures 310, 312 extending therethrough. The apertures 310, 312 in the coupling tab 244 are aligned with the apertures 300, 302 respectively in the coupling tab 242. The coupling tabs 242, 244 have grooves 321, 323, respectively, disposed proximate to the mounting portion 240, wherein the coupling tabs 242, 244 are bendable proximate the grooves 321, 323, respectively, toward one another. The coupling tabs 242, 244 are each constructed of an electrically conductive material. In one exemplary embodiment, coupling tabs 242, 244 are constructed of copper. Of course, in an alternative embodiment, the coupling tabs 242, 244 could each be constructed of another electrically conductive material suitable for a purpose disclosed herein.

The bolt 260 is configured to be disposed through the apertures 300, 310 and is coupled to the nut 264. The bolt 262 is configured to be disposed through the apertures 302, 312 and is coupled to the nut 266. When bolts 260, 262 are tightened within the nuts 264, 266, respectively, the coupling tabs 242, 244 are urged towards one another such that the coupling tabs 242, 244 are fixedly clamped against the second busbar 22 disposed through the gap 250 between the coupling tabs 242, 244. Also, the mounting portion 240 is electrically coupled to the second busbar 22 via the coupling tabs 242, 244.

Figure 9:
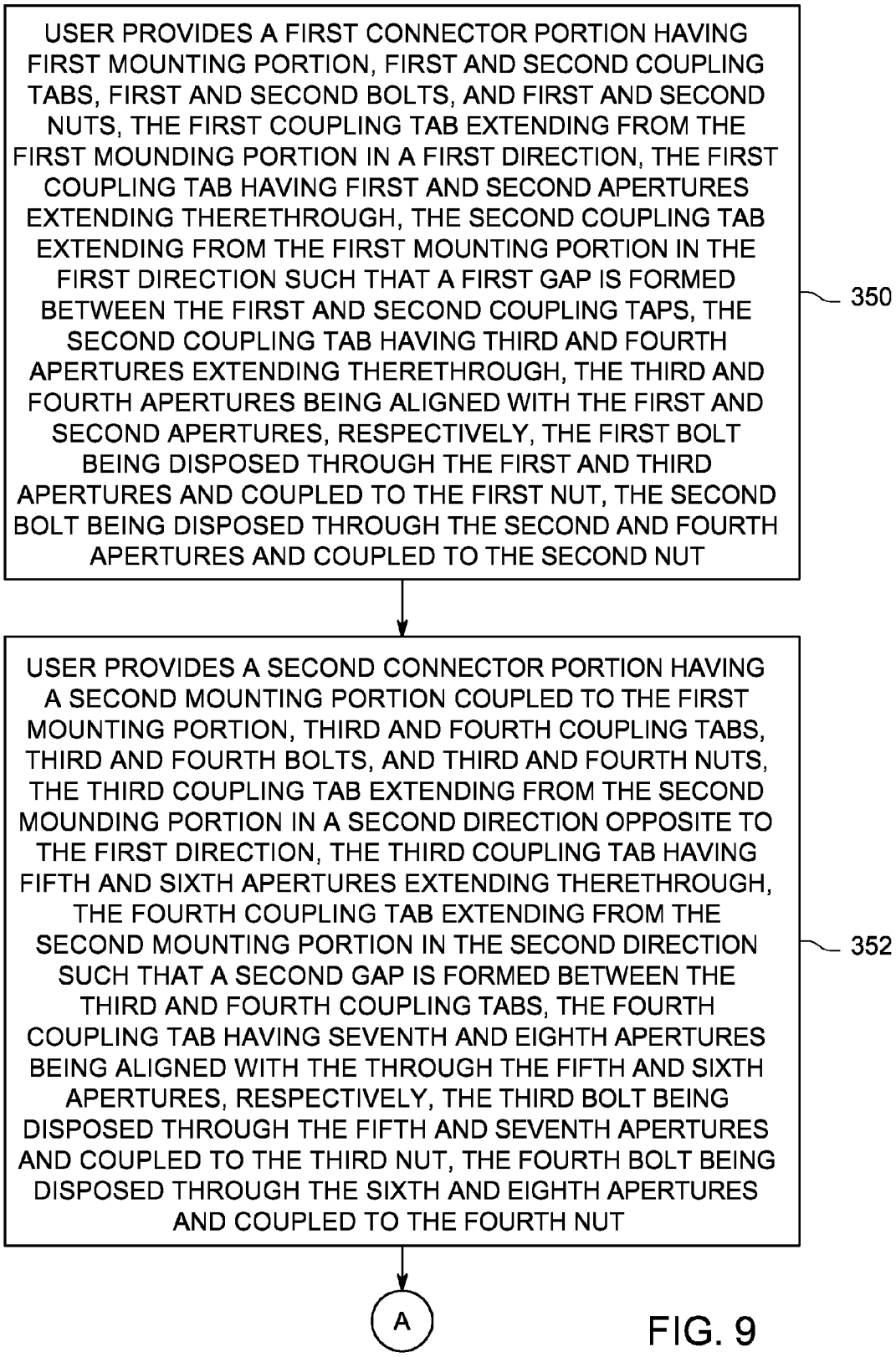
FIGS. 9 and 10 are a flowchart of a method for coupling an electrical connector to a busbar in accordance with another exemplary embodiment.
Figure 10:
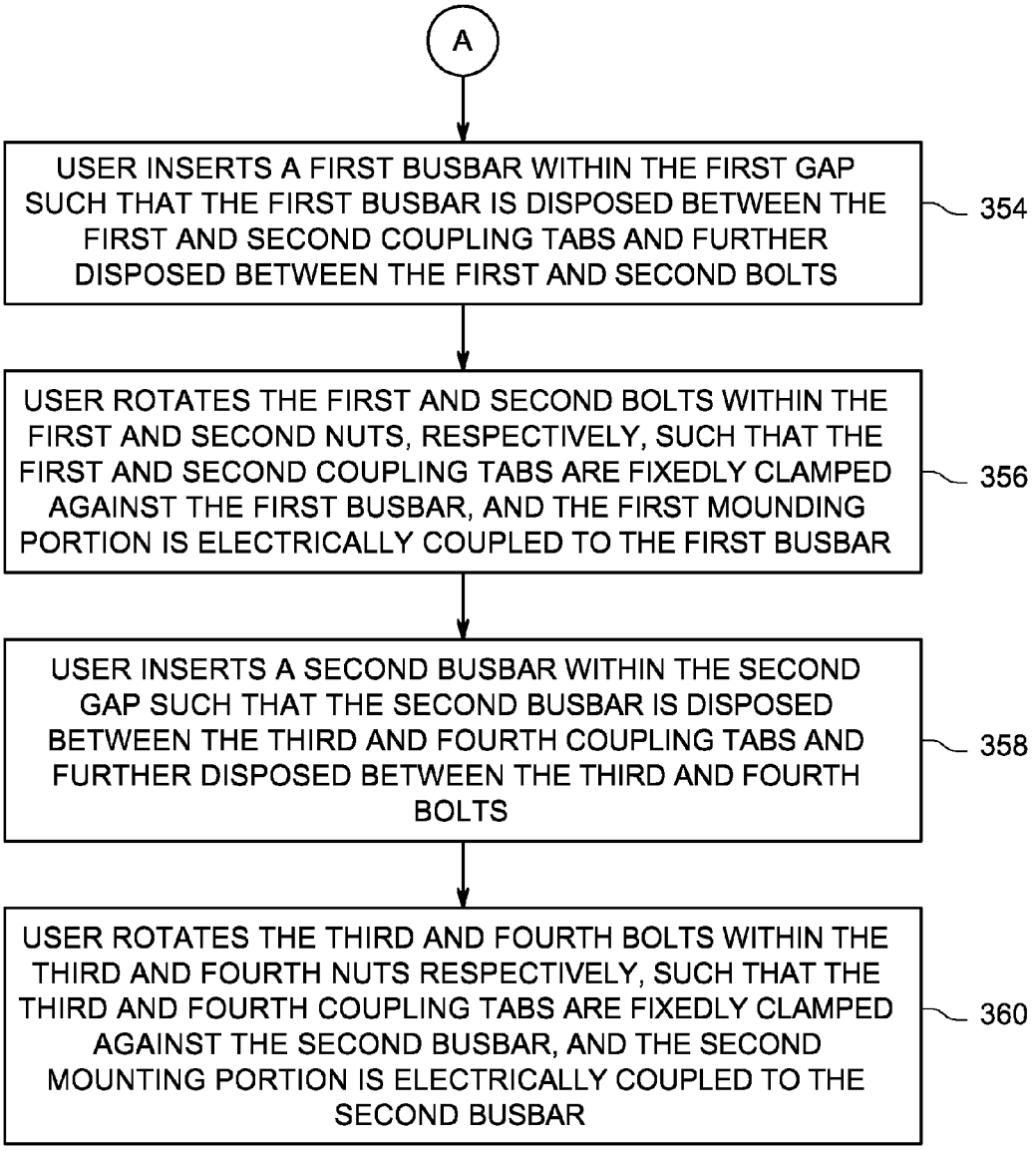

Referring to FIGS. 9 and 10, a flowchart of a method for coupling the electrical connector 30 to busbars 20, 22 in accordance with another exemplary embodiment will be explained.

At step 350, the user provides the first connector portion 31 having a mounting portion 40, coupling tabs 42, 44, bolts 60, 62, and nuts 64, 66. The coupling tab 42 extends from the mounting portion 40 in a first direction. The coupling tab 42 has apertures 100, 102 extending therethrough. The coupling tab 44 extends from the mounting portion 40 in the first direction such that the gap 50 is formed between the coupling tabs 42, 44. The coupling tab 44 has apertures 110, 112 extending therethrough. The apertures 110, 112 are aligned with the apertures 100, 102, respectively. The bolt 60 is disposed through the apertures 100, 110 and is coupled to the nut 64. The bolt 62 is disposed through the apertures 102, 112 and is coupled to the nut 66.

At step 352, the user provides the second connector portion 32 having a mounting portion 240, coupling tabs 242, 244, bolts 260, 262, and nuts 264, 266. The coupling tab 242 extends from the mounting portion 240 in a first direction. The coupling tab 242 has apertures 300, 302 extending therethrough. The coupling tab 244 extends from the mounting portion 240 in the first direction such that the gap 250 is formed between the coupling tabs 242, 244. The coupling tab 244 has apertures 310, 312 extending therethrough. The apertures 310, 312 are aligned with the apertures 300, 302, respectively. The bolt 260 is disposed through the apertures 300, 310 and it is coupled to the nut 264. The bolt 262 is disposed through the apertures 302, 312 and is coupled to the nut 266.

At step 354, the user inserts the first busbar 20 within the gap 50 such that the first busbar 20 is disposed between the coupling tabs 42, 44 and further disposed between the bolts 60, 62.

At step 356, the user rotates the bolts 60, 62 within the nuts 64, 66, respectively, such that the coupling tabs 42, 44 are fixedly clamped against the first busbar 20. Also, the mounting portion 40 is electrically coupled to the first busbar 20.

At step 358, the user inserts the second busbar 22 within the gap 250 such that the second busbar 22 is disposed between the coupling tabs 242, 244 and is further disposed between the bolts 260, 262.

At step 360, the user rotates the bolts 260, 262 within the nuts 264, 266, respectively, such that the coupling tabs 242, 244 are fixedly clamped against the second busbar 22, and the mounting portion 240 is electrically coupled to the second busbar 22.

Embodiments of the electrical connectors and methods for coupling the connectors to busbars described herein provide a substantial advantage over prior art electrical connectors and methods. In particular, the electrical connectors couple together two busbars without having to drill holes in both busbars.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A connector for coupling a first busbar extending in a first direction to a second busbar extending in a second direction, the connector comprising:

a first mounting portion comprising a receiving portion, the receiving portion configured to receive an end portion of the first busbar;

a clamping portion comprising a resilient pivoting member, the clamping portion coupled to an end of the receiving portion the clamping portion configured and disposed to impart a clamping force in a third direction toward the second busbar when the second busbar is disposed between the damping portion and the first busbar; and a second mounting portion coupled to the clamping portion, the second mounting portion configured to be coupled to the first busbar to fixedly hold the second busbar between the clamping portion and the first busbar and to electrically couple the second busbar to the first busbar.

2. The electric al connector of claim 1, wherein the third direction is substantially orthogonal to both the first and second directions.

3. The electrical connector of claim 1, wherein the receiving portion defines a first aperture extending therethrough.

4. The electrical connector of claim 1, wherein the receiving portion defines a first slot formed therein.

5. The electrical connector of claim 1, wherein the second mounting portion has at least one second aperture defined therethrough.

6. The electrical connector of claim 5, further comprising at least one fastener, configured to be operatively disposed in the at least one second aperture.

7. The electrical connector of claim 6, wherein the at least one fastener is a bolt.

8. The electrical connector of claim 1, wherein the clamping portion is constructed of an electrically conductive material.

9. The electrical connector of claim 8, wherein the conductive material is copper.

10. A connector for coupling a first busbar extending in a first direction to a second busbar extending in a second direction, the connector comprising:

a first mounting portion comprising a receiving portion, the receiving portion defining a first slot therein configured to receive an end portion of the first busbar;

a clamping portion coupled to an end of the receiving portion the clamping portion configured and disposed to impart a clamping force in a third direction toward the second busbar when the second busbar is disposed between the clamping portion and the first busbar; and a second mounting portion coupled to the clamping portion, the second mounting portion configured to he coupled to the first busbar to fixedly hold the second busbar between the clamping portion and the first busbar and to electrically couple the second busbar to the first busbar.

11. The electrical connector of claim 10, wherein the third direction is substantially orthogonal to both the first and second directions.

12. The electrical, connector of claim 10, wherein the receiving portion first slot extends therethrough.

13. The electrical connector of claim 10, wherein the second mounting portion has at least one aperture defined therethrough.

14. The electrical connector of claim 13, further comprising at least one fastener, configured to be operatively disposed in the at least one second aperture.

15. The electrical connector of claim 14, wherein the at least one fastener is a bolt.

16. The electrical connector of claim 10, wherein the clamping portion is constructed of an electrically conductive material.

17. The electrical connector of claim 16, wherein the conductive material is copper.

* * * * *

UNITED STATES PATENT AND TRADEMARK OFFICE

CERTIFICATE OF CORRECTION

PATENT NO. : 8,662,940 B2
APPLICATION NO. : 13/338473
DATED : March 4, 2014
INVENTOR(S) : Decuyper et al.

It is certified that error appears in the above-identified patent and that said Letters Patent is hereby corrected as shown below:

In the Drawings

In Fig. 9, Sheet 6 of 11, for Tag "350", in Line 5, delete "MOUNDING" and insert -- MOUNTING --, therefor.

In Fig. 9, Sheet 6 of 11, for Tag "350", in Line 10, delete "TAPS," and insert -- TABS, --, therefor.

In Fig. 9, Sheet 6 of 11, for Tag "352", in Line 6, delete "MOUNDING" and insert -- MOUNTING --, therefor.

In Fig. 10, Sheet 7 of 11, for Tag "356", in Line 4, delete "MOUNDING" and insert -- MOUNTING --, therefor.

Figure 18:
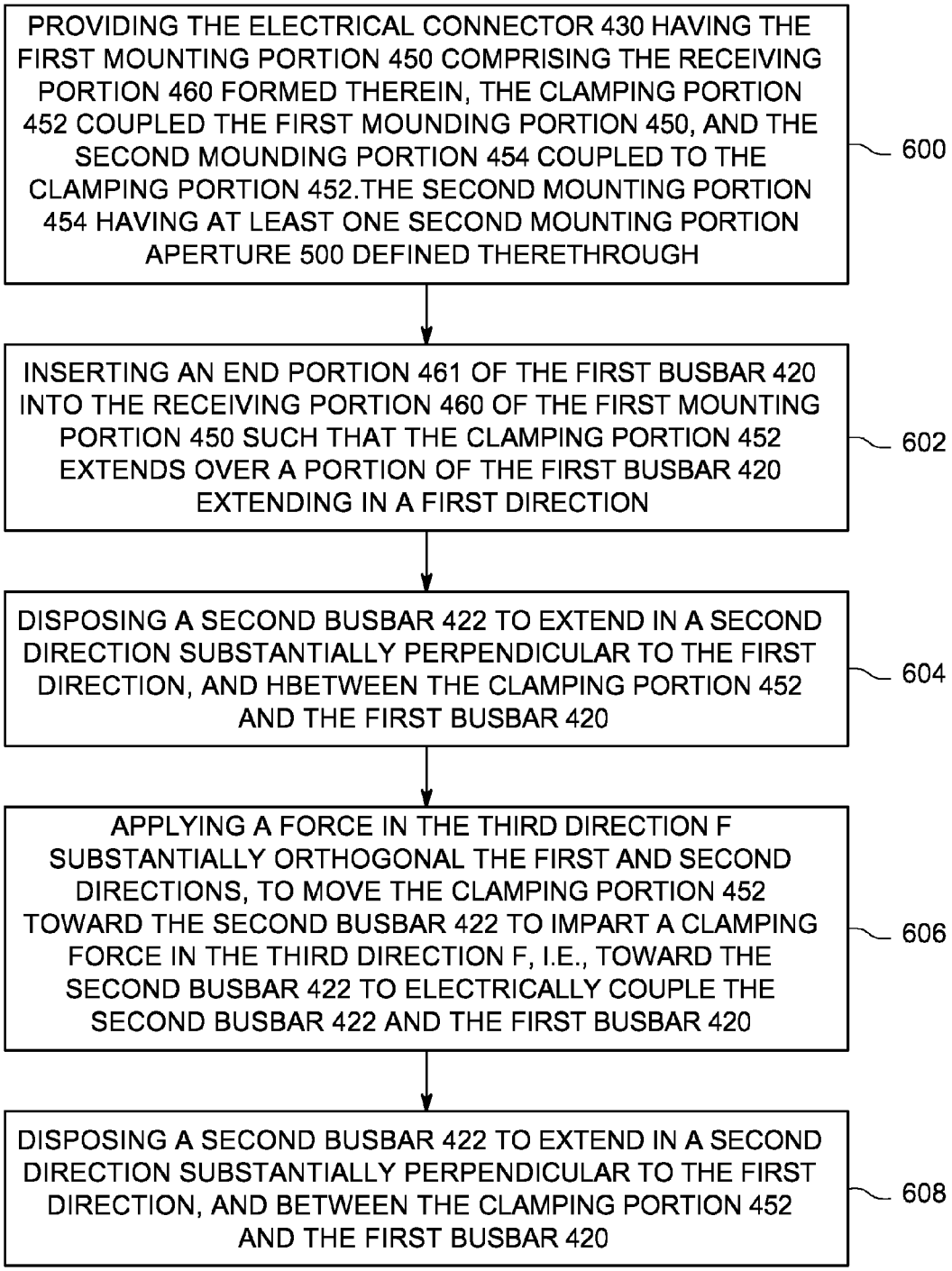
FIG. 18 is a flowchart of a method for coupling an electrical connector to first and second busbars in accordance with another exemplary embodiment.

In Fig. 18, Sheet 11 of 11, for Tag "600", in Line 4, delete "MOUNDING" and insert -- MOUNTING --, therefor In Fig. 18, Sheet 11 of 11, for Tag "600", in Line 5, delete "MOUNDING" and insert -- MOUNTING --, therefor.

In Fig. 18, Sheet 11 of 11, for Tag "604", in Line 3, delete "HBETWEEN" and insert -- BETWEEN --, therefor.

In the Specification

In Column 1, Line 23, delete "An" and insert -- A --, therefor.

In Column 3, Line 20, delete "toward the the" and insert -- toward the --, therefor.

Signed and Sealed this
Tenth Day of June, 2014

Michelle K. Lee

Michelle K. Lee
*Deputy Director of the United States Patent and Trademark Office*

In Column 4, Lines 33-34, delete “toward the the” and insert -- toward the --, therefor.

In the Claims

In Column 7, Line 26, in Claim 1, delete “damping” and insert -- clamping --, therefor.

In Column 7, Line 34, in Claim 2, delete “electric al” and insert -- electrical --, therefor.

In Column 8, Line 21, in Claim 10, delete “he” and insert -- be --, therefor.

In Column 8, Line 30, in Claim 12, delete “electrical,” and insert -- electrical --, therefor.